US010711779B2

(12) United States Patent
Mizukoshi

(10) Patent No.: US 10,711,779 B2
(45) Date of Patent: Jul. 14, 2020

(54) PLUNGER PUMP

(71) Applicant: IWAKI CO., LTD., Tokyo (JP)

(72) Inventor: Mikio Mizukoshi, Sayama (JP)

(73) Assignee: IWAKI CO., LTD., Tokyo (JP)

( * ) Notice: Subject to any disclaimer, the term of this patent is extended or adjusted under 35 U.S.C. 154(b) by 90 days.

(21) Appl. No.: 15/414,374

(22) Filed: Jan. 24, 2017

(65) Prior Publication Data

US 2017/0218950 A1 Aug. 3, 2017

(30) Foreign Application Priority Data

Feb. 1, 2016 (JP) ..... 2016-017468

(51) Int. Cl.
*F04B 53/16* (2006.01)

(52) U.S. Cl.
CPC ..... *F04B 53/162* (2013.01); *F04B 53/166* (2013.01); *F05C 2225/12* (2013.01); *F05C 2251/10* (2013.01)

(58) Field of Classification Search
CPC .. F04B 7/06; F04B 17/03; F04B 19/22; F04B 53/00; F04B 53/10; F04B 53/14; F04B 53/143–144; F04B 53/146; F04B 53/148; F04B 53/16; F04B 53/162; F04B 53/166; F04B 53/168; B21K 3/00; B21K 3/02; F16J 10/04
USPC ..... 417/415, 430, 469, 490–494, 498, 500; 92/169.1, 170.1
See application file for complete search history.

(56) References Cited

U.S. PATENT DOCUMENTS 6,044,821 A * 4/2000 Weng ..... F02F 1/16 123/193.2
2007/0237658 A1* 10/2007 Burns ..... F04B 7/06 417/417
2011/0318205 A1* 12/2011 Aso ..... F04B 13/00 417/437

FOREIGN PATENT DOCUMENTS

CN 102312812 A 1/2012
CN 206874446 U 1/2018
JP 58151935 A * 9/1983 ..... B21C 23/22
JP S58-151935 A 9/1983
JP H01-104487 A 4/1989
JP 2001-248543 A 9/2001
JP 2008-51392 A 3/2008
(Continued)

OTHER PUBLICATIONS

Author: sspseals Title: PEEK material properties data sheet Date published (mm/dd/yyyy): Feb. 1, 2002 Date accessed (mm/dd/yyyy): Mar. 27, 2019 Link: https://www.sspseals.com/pdf/peek%20SSP.pdf (Year: 2002).*
(Continued)

*Primary Examiner* — Patrick Hamo
*Assistant Examiner* — Chirag Jariwala
(74) *Attorney, Agent, or Firm* — Oliff PLC

(57) ABSTRACT

A plunger pump includes a cylinder section having a cylinder chamber and a spacer section sliding against a portion of the plunger closer to a proximal end side than a portion of a plunger advancing and retracting into the cylinder chamber. The cylinder section is made of a material having first hardness, and the spacer section being made of a resin material having second hardness softer than the first hardness. A length in an axial direction from a proximal end of a sliding portion of the spacer section sliding against the
(Continued)

plunger to a distal end of the spacer section is larger than a maximum stroke length of reciprocation of the plunger.

9 Claims, 4 Drawing Sheets

(56) References Cited

FOREIGN PATENT DOCUMENTS

| | | | | | |
|---|---|---|---|---|---|
| JP | 2008051392 | A | * | 3/2008 | |
| JP | 2010-43618 | A | | 2/2010 | |
| JP | 2012-31850 | A | | 2/2012 | |
| JP | 2014-62490 | A | | 4/2014 | |
| WO | WO-2012002141 | A1 | * | 1/2012 | ..... F04B 7/06 |

OTHER PUBLICATIONS

Author: Reade Title: Mohs' Hardness (typical) of abrasives Date published (mm/dd/yyyy): Feb. 1, 2001 Date accessed (mm/dd/yyyy): Mar. 27, 2019 Link: https://www.reade.com/reade-resources/reference-educational/reade-reference-chart-particle-property-briefings/32-mohs-hardness-of-abrasives (Year: 2001).*

Mar. 29, 2016 Office Action issued in Japanese Patent Application No. 2016-017468.

* cited by examiner

PLUNGER PUMP

CROSS-REFERENCE TO RELATED APPLICATIONS

This application is based upon and claims the benefit of priority from the prior Japanese Patent Application No. 2016-017468, filed on Feb. 1, 2016, the entire contents of which are incorporated herein by reference.

BACKGROUND OF THE INVENTION

Field of the Invention

The present invention relates to a plunger pump that transfers fluid by rotating and reciprocating a plunger in a cylinder chamber to let a suction port and a discharge port alternately communicate with the cylinder chamber.

Description of the Prior Art

As disclosed in JP 2001-248543 A and JP 2008-51392 A, for example, a conventional plunger pump has been known that transfers fluid by rotating and reciprocating a plunger having a cut face on the outer periphery of its distal end in a cylinder chamber to let a suction port and a discharge port alternately communicate with the cylinder chamber.

If fluid that has characteristics of precipitation or depositing is transferred by such a plunger pump, precipitation or depositing may occur and disable sliding of the plunger in the cylinder and stop the pump. A plunger pump 100 disclosed in JP 2001-248543 A and JP 2008-51392 A as illustrated in FIG. 7, for example, includes depositing prevention ports 104a and 104b provided in a cylinder 101 at locations closer to the proximal end side than a suction port 102 and a discharge port 103 provided on the outer circumference of the cylinder 101 in the vicinity of the distal end.

Washing liquid is supplied from external to the depositing prevention ports 104a and 104b. The washing liquid washes away the fluid that has characteristics of precipitation or depositing from the clearance between the inner circumferential face 105 of the cylinder 101 and the outer circumferential face 106 of the plunger to prevent stopping of the pump caused by precipitation or depositing.

Under some operating conditions, such as the place where the pump is set and the operating environment, the washing liquid cannot be used or an additional flow passage for the washing liquid, including the depositing prevention ports 104a and 104b, cannot be provided. A plunger pump having a structure that can prevent stopping of the pump caused by precipitation or depositing regardless of the operating condition of the pump is desired.

SUMMARY OF THE INVENTION

The present invention is made in view of the aforementioned problem. An object of the present invention is to provide a plunger pump that prevents stopping of the pump caused by precipitation or depositing under any operating condition.

A plunger pump according to an embodiment of the present invention includes a cylinder having inside a cylinder chamber, a plunger disposed in the cylinder so as to be relatively movable forward and backward to the cylinder chamber so that an outer circumferential face of the plunger is in slide contact with an inner circumferential face of the cylinder, and having a cut face on an outer periphery of an distal end, and a suction port and a discharge port provided to the cylinder to communicate with the cylinder chamber, the plunger pump transferring fluid by reciprocating the plunger in an axial direction while rotating the plunger relative to the cylinder chamber to let the suction port and the discharge port alternately communicate with the cylinder chamber, the cylinder including a cylinder section having the cylinder chamber and a spacer section sliding against a portion of the plunger closer to a proximal end side than a portion of the plunger advancing and retracting into the cylinder chamber, the cylinder section being made of a material having first hardness, the spacer section being made of a resin material having second hardness softer than the first hardness, a length in the axial direction from a proximal end of a sliding portion of the spacer section sliding against the plunger to a distal end of the spacer section being larger than a maximum stroke length of reciprocation of the plunger.

In another embodiment of the plunger pump, the length in the axial direction from the proximal end of the sliding portion of the spacer section to the distal end of the spacer section is larger than a length of the cylinder section in the axial direction.

In another embodiment of the plunger pump, a maximum of the length in the axial direction from the proximal end of the sliding portion of the spacer section to the distal end of the spacer section is smaller than a length in the axial direction from the proximal end of the sliding portion of the spacer section to a boundary step of the cut face on the outer circumferential face of the plunger in a fully retracted position.

Another embodiment of the plunger pump includes an axial seal provided at a proximal end side of the cylinder to seal between the cylinder and the plunger.

In another embodiment of the plunger pump, the spacer section is made of a water-repellant material.

In another embodiment of the plunger pump, a liquid reservoir is provided at least in one of an inner circumferential face of the spacer section, an inner circumferential face of the cylinder section, and an outer circumferential face of the plunger.

In another embodiment of the plunger pump, the cut face is formed on the plunger so as to oppose an inner circumferential face of the spacer section when the plunger is at a position farthest from a distal end of the cylinder in the axial direction.

In another embodiment of the plunger pump, the plunger is made of a material having the first hardness.

In another embodiment of the plunger pump, the first hardness is 8 to 13 in Mohs hardness and the second hardness is 119 to 130 in Rockwell hardness in R scale.

In another embodiment of the plunger pump, the cylinder section is made of a silicon carbide or an alumina ceramic material, the plunger is made of any one of a silicon carbide, an alumina ceramic material, a zirconia ceramic material, and a stainless steel material, and the spacer section is made of a resin material having a compression strength of 89 MPa or above.

In another embodiment of the plunger pump, the resin material is any one of polyphenylene sulfide (PPS) resin, polyether ether ketone (PEEK) resin, polysulfone (PSU) resin, polyacetal (POM) resin, and polyamide 6 or Nylon 6 (PA6) resin.

Effects of the Invention

According to the present invention, stopping of a pump caused by precipitation or depositing can be prevented under any operating condition.

The accompanying drawings, which are incorporated in and constitute a part of the specification, illustrate embodiments of the invention, and together with the general description given above and the detailed description of the embodiments given below, serve to explain the principles of the invention.

DESCRIPTION OF THE PREFERRED EMBODIMENTS

A plunger pump according to an embodiment of the present invention will now be described below in detail with reference to the attached drawings. The embodiment will be described not by way of limiting the scope of the claims of the present invention. Combinations of the features described in the embodiments are not always necessary to constitute the means for solving the problem according to the present invention.

First Embodiment

Figure 1:
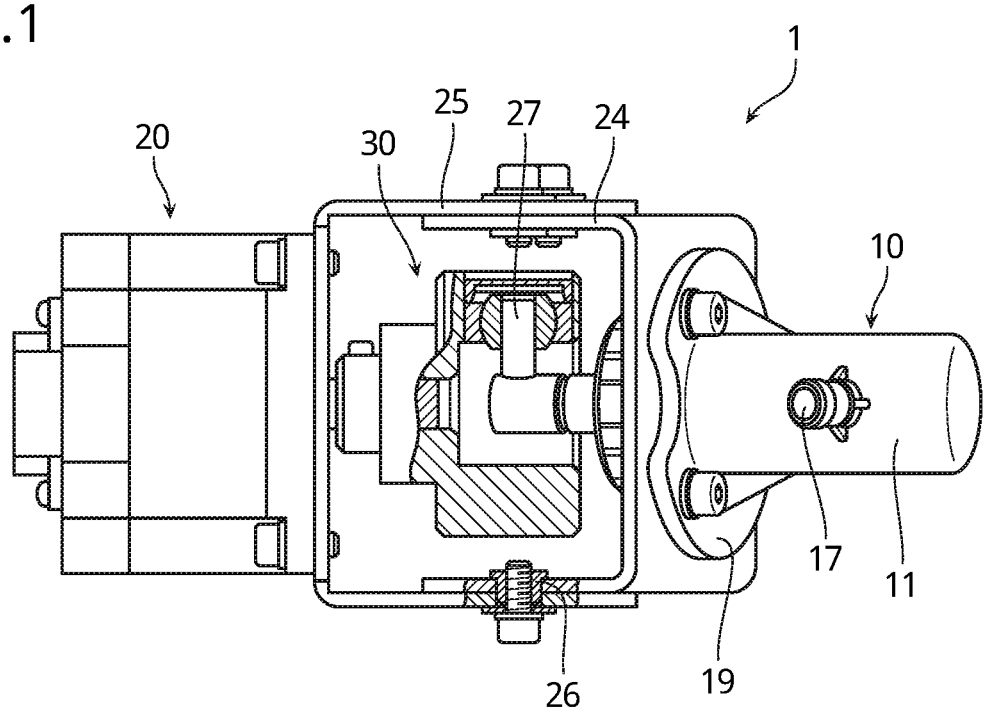
FIG. 1 is a partially cut out front view illustrating a plunger pump according to a first embodiment of the present invention.
Figure 2:
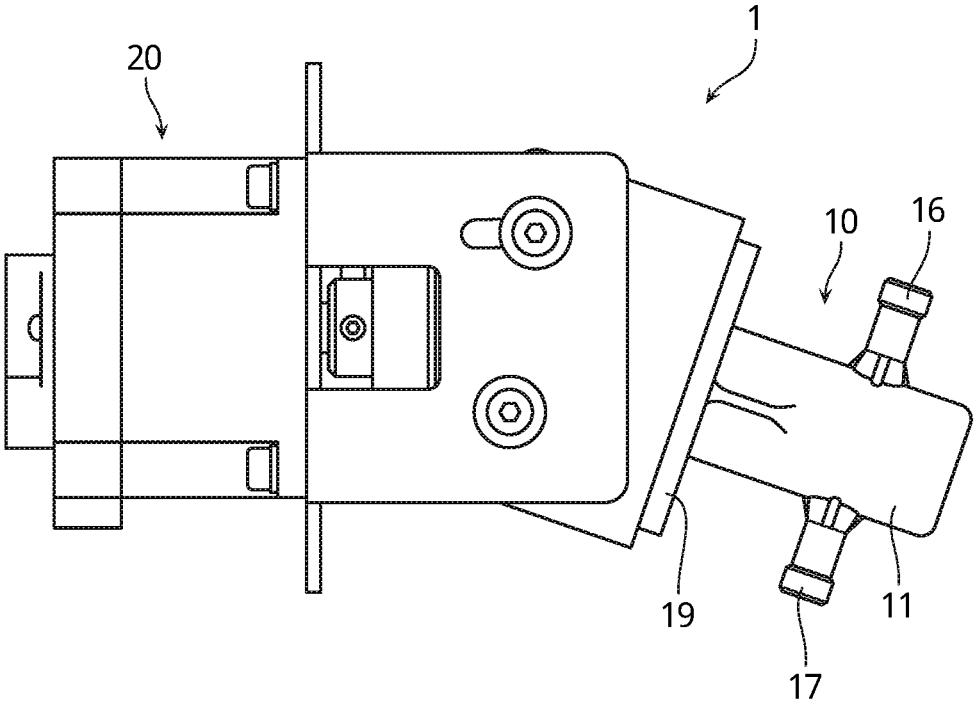
FIG. 2 is a side view illustrating the plunger pump according to the first embodiment.
Figure 3:
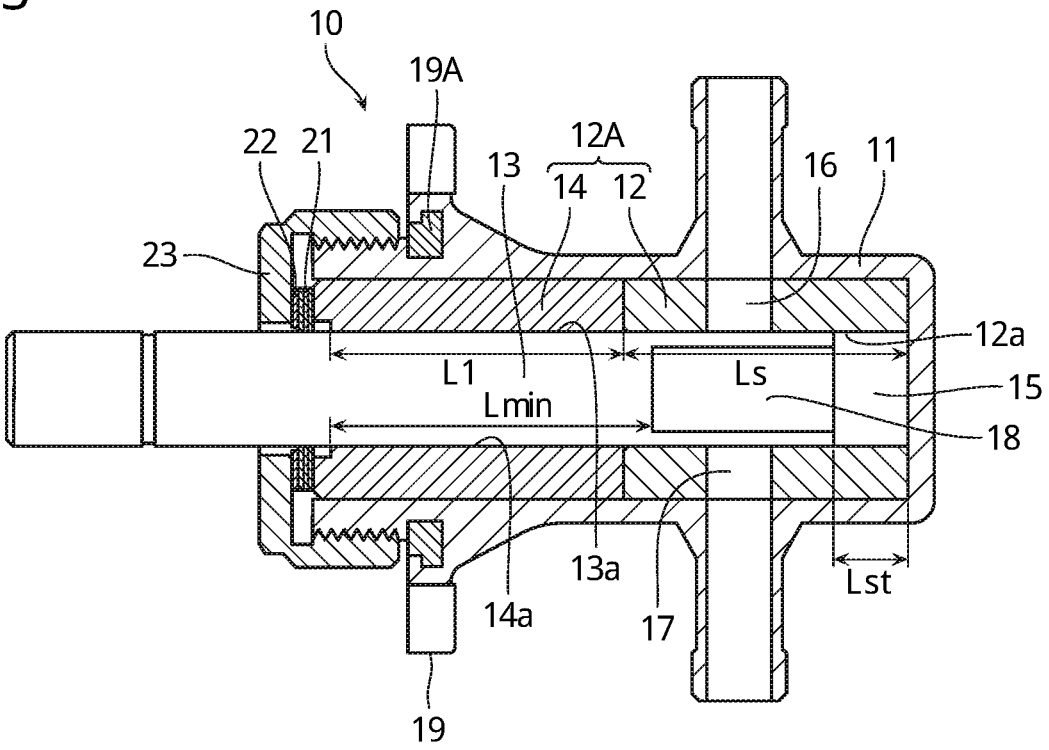
FIG. 3 is a sectional view illustrating a pump head of the plunger pump according to the first embodiment.

FIG. 1 is a partially cut out front view illustrating a plunger pump 1 according to a first embodiment of the present invention. FIG. 2 is a side view illustrating the plunger pump 1. FIG. 3 is a sectional view illustrating a pump head 10 of the plunger pump 1.

As illustrated in FIGS. 1 and 2, the plunger pump 1 according to the first embodiment is usable mainly for transferring fluid that has characteristics of precipitation or depositing. The fluid to be transferred may be a fluid that easily causes precipitation or depositing, such as buffer liquid (buffer solution) similar to normal saline solution used in, for example, a medical analysis device and dialysis solution used in a dialysis device.

The plunger pump 1 includes a pump head 10 as a main part, a motor 20 that drives a plunger 13 of the pump head 10, and a drive joint unit 30 that joins the plunger 13 and the motor 20.

As illustrated in FIG. 3, the pump head 10 includes a cylinder 12A housed in a pump bracket 11 made of, for example, polyvinylidene fluoride (PVDF) resin or chlorotrifluoroethylene-ethylene copolymer (ECTFE) and the plunger 13 disposed in the cylinder 12A.

The cylinder 12A of the plunger pump 1 according to the first embodiment includes a cylinder section 12 disposed in a distal end side in the pump head 10 and a spacer section 14 disposed in a proximal end side in the pump head 10. An inner circumferential face 12*a* of the cylinder section 12 and an inner circumferential face 14*a* of the spacer section 14 are concentric with each other and form the same cylindrical surface. The inner circumferential faces 12*a* and 14*a* are in slide contact with an outer circumferential face 13*a* of the plunger 13. The cylinder section 12 of the cylinder 12A and the plunger 13 are made of, for example, ceramic material, more specifically, alumina ($Al_2O_3$) ceramic material having the Mohs hardness of 8 to 9.

A cylinder chamber 15 plugged by the pump bracket 11 is formed at the distal end of the cylinder 12A. The cylinder 12A has a valve-less suction port 16 and a valve-less discharge port 17 that oppose each other in a direction perpendicular to the axial direction of the cylinder 12A. The suction port 16 and the discharge port 17 are located so as to communicate with the cylinder chamber 15. The plunger 13 has a cut face 18 on the outer periphery of the distal end. A pin 27 is attached to the proximal end of the plunger 13 at a right angle to the shaft of the plunger 13. The pin 27 is coupled via the drive joint unit 30 to the rotating shaft of the motor 20. The rotating shaft of the plunger 13 and the rotating shaft of the motor 20 are not in line but are adjusted to intersect at a predetermined angle.

With this adjustment, the plunger 13 is driven by the motor 20 to rotate and reciprocate in the axial direction relative to the cylinder chamber 15. This motion causes the suction port 16 and the discharge port 17 to alternately communicate with the cylinder chamber 15 via the cut face 18, and thereby the transferred fluid is suctioned through the suction port 16 and discharged through the discharge port 17. The fluid is thereby transferred. A flange 19 for mounting the pump head 10 to the distal face of a front frame 24 is provided in the vicinity of the proximal end side of the pump bracket 11. The flange 19 is reinforced by an insert flange 19A that is inserted in the flange 19 and made of, for example, aluminum. A plurality of lip seals (axial seals) 21 and a back sheet 22 made of, for example, polytetrafluoroethylene (PTFE) resin are provided at the proximal end side of the spacer section 14.

The lip seals 21 and the back sheet 22 are secured at the thread portion of the proximal portion of the pump bracket 11 by screwing a nut 23 made of, for example, polypropylene (PP) resin to bring at least the lip seals 21 to be in tight contact with the proximal end of the cylinder 12A and the outer circumferential face 13*a* of the plunger 13. The motor 20 is, for example, a stepping motor. The drive joint unit 30 is housed inside the front frame 24 and a rear frame 25 made of, for example, a stainless steel (SUS304). A pivot shaft 26 allows the pump head 10 to be adjusted to any angle to the rear frame 25, for example.

The plunger pump 1 according to the first embodiment configured as described above is in a start state when the suction port 16 is in communication with the cylinder chamber 15 as the leading side edge of the cut face 18 on the distal end of the plunger 13 is brought to the suction port 16 along with the rotation of the plunger 13. From this state, when the plunger 13 rotates in a predetermined direction and retracts out of the cylinder chamber 15 of the cylinder 12A, the suction state starts in which the fluid is suctioned through the suction port 16 into the cylinder chamber 15.

Then, when the trailing side edge of the cut face 18 on the distal end of the plunger 13 moves away from the suction port 16, the suction port 16 is plugged by the plunger 13 and the suction stroke ends. Then, the leading side edge of the cut face 18 on the distal end of the plunger 13 is brought to the discharge port 17 and thereby the discharge port 17 is in communication with the cylinder chamber 15.

Simultaneously, the plunger 13 is rotated and pushed into the cylinder chamber 15 of the cylinder 12A and the phase switches to the discharge stroke in which the fluid is discharged from the cylinder chamber 15 through the discharge port 17. Then, the trailing side edge of the cut face 18 on the distal end of the plunger 13 moves away from the discharge port 17 to plug the discharge port 17 with the plunger 13, thereby ending the discharge stroke. The plunger 13 is further rotated to return to the start state described above. The similar motion is repeated to transfer the fluid from the suction port 16 to the discharge port 17.

The plunger pump 1 may stop during an operation by such a cause that will be described below. In the plunger pump 1, the lip seals 21, the back sheet 22, and the nut 23 are provided to prevent the fluid that has flowed in the axial direction of the plunger 13 through a slight clearance between the plunger 13 and the cylinder 12A from leaking outside the pump bracket 11. The lip seals 21 also prevent intrusion of the ambient air into the inside of the spacer section 14 which may cause precipitation or depositing. The lip seals 21 are disposed such that the effects described above are best achieved together with the spacer section 14 as illustrated in FIG. 3.

However, since the plunger pump 1 is configured that the plunger 13 reciprocates relative to the cylinder 12A, a slight amount of fluid leaks out on the surface of the plunger 13. The fluid might leak outside if the lip seals 21 or other seals wear or deteriorate.

If a precipitate forms in the fluid or a depositing occurs in the fluid, the precipitate or the deposit intrudes into the clearance between the plunger 13 and the cylinder 12A by reciprocation of the plunger 13. The plunger 13 and the cylinder section 12 of the cylinder 12A made of a very hard alumina ceramic material that hardly deforms as described above will not deform against an object intruded in a slight gap and bites the object. This causes locking and stops the pump.

In the first embodiment, the sliding portion between the plunger 13 and the cylinder 12A where such an object easily intrudes, that is, the spacer section 14, is made of a softer material than the plunger 13 and the cylinder section 12. With this configuration, the spacer section 14 of the cylinder 12A deforms or wears against an object intruded into the clearance between the plunger 13 and the cylinder 12A. This avoids the object being bitten between the plunger 13 and the cylinder 12A, and thus prevents the pump from stopping.

As described above, the cylinder section 12 of the cylinder 12A and the plunger 13 are made of a very hard alumina ceramic material. The hardness of sodium chloride (NaCl), which precipitates and deposits in the buffer liquid, or the fluid, is about 2 to 2.5 in Mohs hardness (about 60 to 100 in Vickers hardness), for example. The hardness of calcium carbonate ($CaCO_3$), which precipitates and deposits in a dialysis solution is, for example, about 3 in Mohs hardness.

Meanwhile, the spacer section 14 is made of a material, for example, having the Rockwell hardness of about 119 to 130 in R scale, more preferably a resin material having in addition a compression strength of about 89 MPa or above. The resin material is preferably any one of polyphenylene sulfide (PPS) resin, polyether ether ketone (PEEK) resin, polysulfone (PSU) resin, polyacetal (POM) resin, and polyamide 6 or Nylon 6 (PA6) resin.

At this point, the PPS resin has the Rockwell hardness of about 123 in R scale and a compression strength of about 110 MPa. The PEEK resin, the PSU resin, and the POM resin have the Rockwell hardness of about 120 in R scale and respectively have the compression strength of about 125 MPa, about 276 MPa, and about 110 MPa. The PA6 resin has the Rockwell hardness of about 119 in R scale and a compression strength of about 89 to 110 MPa.

As described above, the material for the spacer section 14 is required to be softer than the precipitate and deposit formed of sodium chloride or calcium carbonate or to have such a strength that allows deformation caused by the moving plunger 13 and precipitate or deposit. In the meantime, the spacer section 14 press-fit in the pump bracket 11 of the pump head 10 made of PVDF or ECTFE is required to have enough strength to prevent deformation by a tightening force from the surroundings.

A typical resin material, such as plastics most of which are usually too soft to be evaluated by the Mohs hardness, has a strength that allows deformation and wear by a precipitate or a deposit and thus can be used for the spacer section 14. Regarding the other requirement against the tightening force applied by the pump bracket 11, the resin material having sufficient hardness or compression strength is required.

A preferable resin material satisfying the requirement is the PPS resin, the PEEK resin, the PSU resin, the POM resin, and the PA6 resin as described above. Consequently, any resin material satisfying the Rockwell hardness of about 119 to 130 in R scale and a compression strength of about 89 MPa or above can be used to form the spacer section 14 that is able to prevent stopping of the pump caused by precipitation or depositing under any operating condition.

Furthermore, polypropylene (PP) resin, polyethylene (PE) resin, and polytetrafluoroethylene (PTFE) resin, which are very commonly used, respectively have the Rockwell hardness in R scale of about 65 to 96, about 40, and about 20 and respectively have the compression strength of about 25 to 55 MPa, about 19 to 25 MPa, and about 10 to 15 MPa. Regarding the hardness and the compression strength, these materials are slightly inferior to the material described above to be used as the material of the spacer section 14. Besides, the spacer section 14 may be made of a water-repellant material. To improve water-repellency, for example, an additive may be mixed in the resin material described above, a surface property may be modified, or the surface of the inner circumferential face 14*a* of the spacer section 14 may be treated (coated) with a fluorine resin material. In such a manner, the amount of the fluid flowing toward the proximal end side of the spacer section 14 can be reduced, and the influence caused by precipitation and depositing is further minimized.

As illustrated in FIG. 3 in the first embodiment, for example, the plunger pump 1 has length L1 larger than length Lst, where L1 is the length in the axial direction from the proximal end of the sliding portion of the spacer section 14 that slides against the plunger 13 to the distal end of the spacer section 14 and Lst is the maximum stroke length of the reciprocation of the plunger 13. Moreover, for example, the length L1 from the proximal end of the sliding portion of the spacer section 14 to the distal end of the spacer section 14 is larger than length Ls which is the length in the axial direction of the cylinder section 12. That is, as illustrated in FIG. 3, the spacer section 14 occupies, for example, half or more of the total length of the cylinder 12A in the axial direction.

Configured as described above, the precipitate or deposit formed in the proximal end side of the plunger 13 at a place exposed to the atmospheric gas (air) can hardly be conveyed to the cylinder section 12 through the spacer section 14 by stroking of the plunger 13. Together with the configuration described above, stopping of the pump caused by precipitation or depositing can further be prevented.

The maximum of the length L1 in the axial direction from the proximal end of the sliding portion of the spacer section 14 to the distal end of the spacer section 14 is set, for example, smaller than length Lmin which is the length from the proximal end of the sliding portion of the spacer section 14 to the boundary step of the cut face 18 on the outer circumferential face 13*a* of the plunger 13 in a fully retracted position. With the length L1 set in such a length, the cut face 18 is always kept inside the cylinder section 12 and thus the leakage of the fluid toward the proximal end side of the plunger 13 can be prevented. Moreover, the discharge amount is less affected in a case under a high secondary pressure.

Second Embodiment

Figure 4:
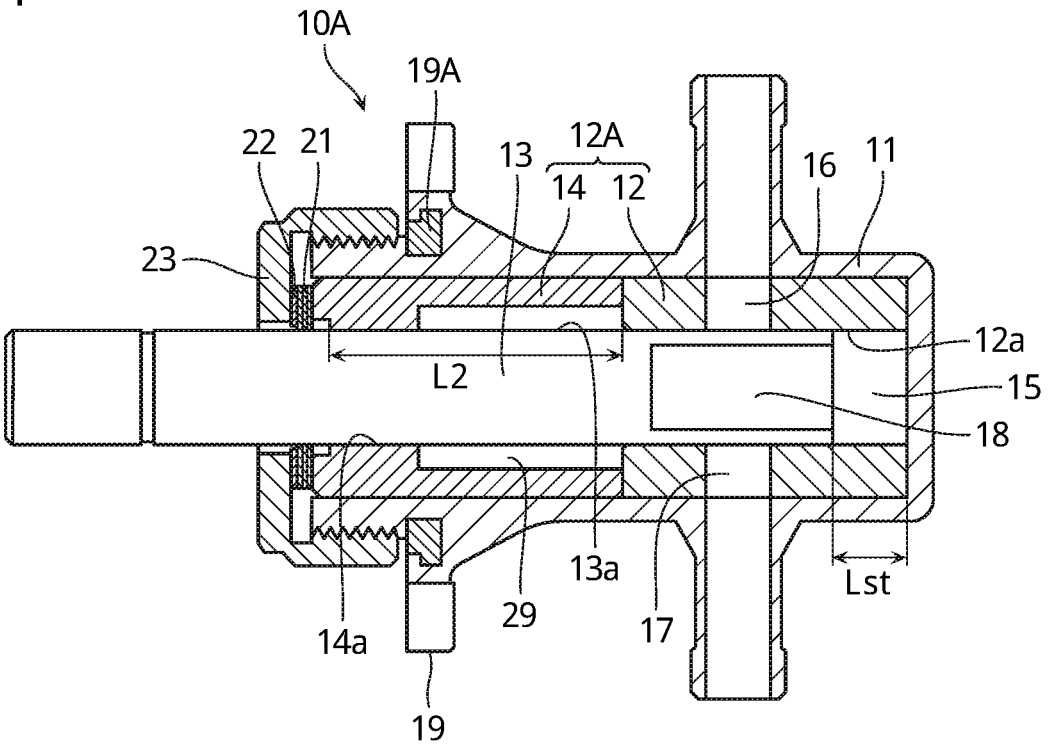
FIG. 4 is a sectional view illustrating the pump head of a plunger pump according to a second embodiment of the present invention.

FIG. 4 is a sectional view illustrating a pump head 10A of a plunger pump 1 according to a second embodiment of the present invention. Hereinafter in the description including FIG. 4, the same component as the first embodiment is appended with the same reference numeral and repeated description thereof is omitted.

As illustrated in FIG. 4, the pump head 10A of the plunger pump 1 according to the second embodiment includes a liquid reservoir 29 provided in the spacer section 14, which together with the cylinder section 12 constitutes the cylinder 12A, to open to the cylinder section 12 with a diameter larger than the diameter of the inner circumferential face 14*a* of the spacer section 14.

This liquid reservoir 29 features the configurational difference in contrast to the pump head 10 of the plunger pump 1 according to the first embodiment in which the whole inner circumferential face 14*a* of the spacer section 14 is in slide contact with the outer circumferential face 13*a* of the plunger 13. The liquid reservoir 29 may take a form of a groove and may be provided in the inner circumferential face 12*a* of the cylinder section 12 or the outer circumferential face 13*a* of the plunger 13. The liquid reservoir 29 keeps the inside of the spacer section 14 in a wet condition, thereby reducing occurrence of precipitation and depositing. Also in the second embodiment, length L2 in the axial direction from the proximal end of the sliding portion of the spacer section 14 to the distal end of the spacer section 14 is larger than the maximum stroke length Lst of the plunger 13.

Third Embodiment

Figure 5:
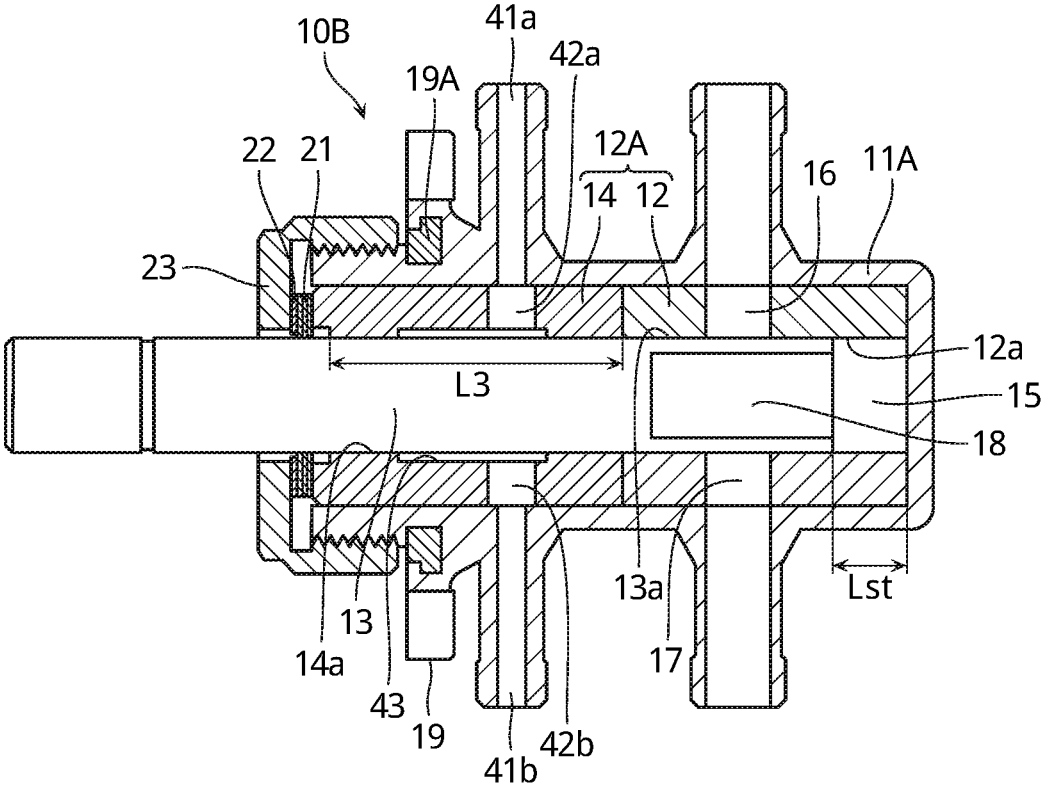
FIG. 5 is a sectional view illustrating a pump head of a plunger pump according to a third embodiment of the present invention.

FIG. 5 is a sectional view illustrating a pump head 10B of a plunger pump 1 according to a third embodiment of the present invention. As illustrated in FIG. 5, the pump head 10B of the plunger pump 1 according to the third embodiment includes washing liquid tubes 41*a* and 41*b* provided on a portion of the pump bracket 11A where the spacer section 14 is housed. The spacer section 14 is provided with depositing prevention ports 42*a* and 42*b* respectively communicating with the washing liquid tubes 41*a* and 41*b*, and a wash chamber 43.

The washing liquid is supplied from the external to the wash chamber 43 through the washing liquid tubes 41*a* and 41*b* and the depositing prevention ports 42*a* and 42*b*. The washing liquid washes off the fluid, which has characteristics of precipitation and depositing, intruded from the cylinder chamber 15 into the clearance between the inner circumferential face 14*a* of the spacer section 14 and the outer circumferential face 13*a* of the plunger 13. In a case where the fluid cannot be washed off completely in the wash chamber 43, the spacer section 14 effectively prevents stopping of the pump caused by precipitation or depositing. This configuration features the difference in contrast to the pump heads 10 and 10A of the plunger pump 1 according to the first embodiment in which the whole inner circumferential face 14*a* of the spacer section 14 is in slide contact with the outer circumferential face 13*a* of the plunger 13 and the second embodiment provided with the liquid reservoir 29. Also in the third embodiment, length L3 in the axial direction from the proximal end of the sliding portion of the spacer section 14 to the distal end of the spacer section 14 is longer than the maximum stroke length Lst of the plunger 13.

Fourth Embodiment

Figure 6:
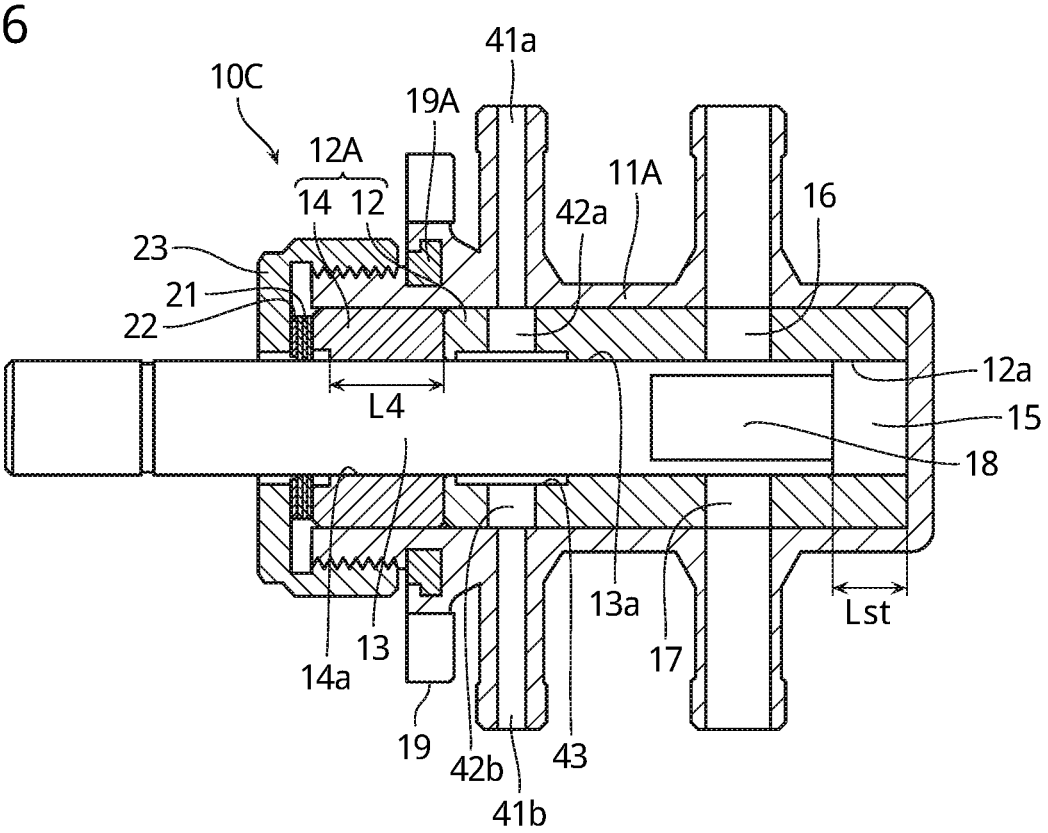
FIG. 6 is a sectional view illustrating a pump head of a plunger pump according to a fourth embodiment of the present invention.
Figure 7:
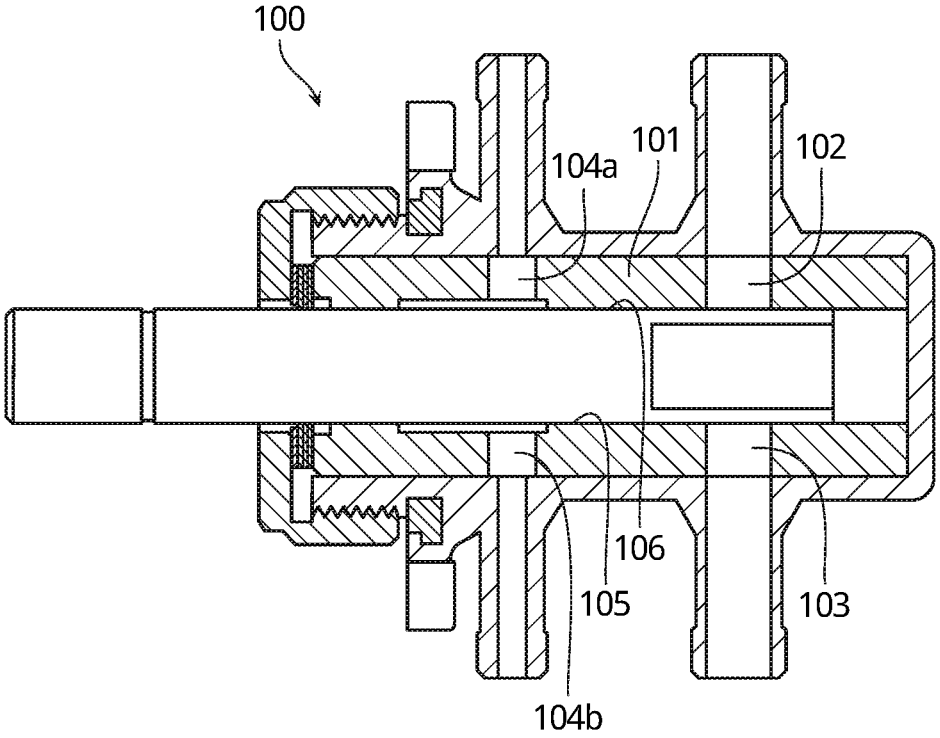
FIG. 7 is a sectional view illustrating a pump head of a conventional plunger pump.

FIG. 6 is a sectional view illustrating a pump head 10C of a plunger pump 1 according to a fourth embodiment of the present invention. As illustrated in FIG. 6, the pump head 10C of the plunger pump 1 according to the fourth embodiment includes a pump bracket 11A which is similar to that of the third embodiment in appearance. The difference is that washing liquid tubes 41*a* and 41*b*, depositing prevention ports 42*a* and 42*b*, and the wash chamber 43 are provided nearer to the proximal end side than the suction port 16 and the discharge port 17 of the cylinder section 12. Although the spacer section 14 has a smaller length in the axial direction of the plunger 13 than that of the third embodiment, length L4 in the axial direction from the proximal end of the sliding portion of the spacer section 14 to the distal end of the spacer section 14 is larger than the maximum stroke length Lst of the plunger 13. Thus, an effect similar to that described above can be provided.

The embodiments are described above by way of illustration, not by way of limiting the scope of the present invention. The embodiments can be set forth in other various forms. Omission, substitution, and alteration can be made in various ways without departing from the spirit and the scope of the present invention. The embodiments and modifications thereof are included in the spirit and the scope of the present invention and within the scope of the invention described by the claims and within the scope according to the doctrine of equivalence.

For example, stopping of the pump can be prevented in a configuration without the lip seal 21 and other seals which are used in the embodiment described above to seal the proximal end of the spacer section 14. For example, in addition to the configuration described above, dimensions such as the clearance between the outer circumferential face 13*a* of the plunger 13 and the inner circumferential face 14*a* of the spacer section 14 and the length in the axial direction may be adjusted to such values that prevent precipitation or depositing in the fluid to be transferred. This further prevents stopping of the pump.

To keep the spacer section 14 in a more preferable wet condition, it is effective to design the cylinder 12A to have such a length that allows the cut face 18 of the plunger 13 to reach the spacer section 14 on completion of the suction stroke (when the plunger 13 is fully retracted). This is because the dimension of the cylinder 12A has almost no effect on the preciseness of the flow rate of the plunger pump 1. The material of the spacer section 14 is not necessarily a resin but may be one of various materials softer than the crystal of the foreign object. A high torque is required of the motor 20 to cause deformation of the spacer section 14, so that the matching between the motor torque and the material of the spacer section 14 is essential.

The embodiment described above has the cylinder section 12 of the cylinder 12A and the plunger 13 made of an alumina ceramic material having the Mohs hardness of 8 to 9. The materials of the cylinder section 12 and the plunger 13 may be a combination of materials as will be described below. If the cylinder section 12 is made of a silicon carbide (SiC) having the Mohs hardness of 13, the plunger 13 is also made of silicon carbide. If the cylinder section 12 is made of an alumina ceramic material, the plunger 13 is made of a zirconia ceramic material having the Mohs hardness of 8 to 8.5. The plunger 13 may be made of a stainless steel material (SUS 316). Such a case does not contradict the description of the present invention, since resin, stainless steel (SUS316), zirconia ceramic material, alumina ceramic material, and silicon carbide become harder in this order. The depositing prevention ports 42*a* and 42*b* provided in the third and fourth embodiments may be provided in either the cylinder section 12 or the spacer section 14 of the cylinder 12A to preferably obtain the effect of the present invention.

What is claimed is:

1. A plunger pump comprising:

a cylinder having inside a cylinder chamber;

a plunger disposed in the cylinder so as to be relatively movable forward and backward to the cylinder chamber so that an outer circumferential face of the plunger is in slide contact with an inner circumferential face of the cylinder, and having a cut face on an outer periphery of a distal end of the plunger; and a suction port and a discharge port provided to the cylinder to communicate with the cylinder chamber, the plunger pump transferring fluid by reciprocating the plunger in an axial direction while rotating the plunger relative to the cylinder chamber to let the suction port and the discharge port alternately communicate with the cylinder chamber, the cylinder including a cylinder section having the cylinder chamber and a spacer section having a sliding portion that is in slide contact with a portion of the plunger closer to a proximal end of the plunger than a portion of the plunger advancing and retracting into the cylinder chamber, the cylinder section being made of a material having first hardness, the spacer section being made of a resin material having second hardness softer than the first hardness, a length in the axial direction from a proximal end of the sliding portion of the spacer section to a distal end of the spacer section being larger than a maximum stroke length of reciprocation of the plunger, a proximal end of the spacer section being disposed between the proximal end and the distal end of the plunger, and the cylinder section has a first connection surface at a longitudinal end of the cylinder section and the spacer section has a second connection surface at a longitudinal end of the spacer section opposing the longitudinal end of the cylinder section, the first connection surface and the second connection surface being joined together in the axial direction, wherein a maximum of the length in the axial direction from the proximal end of the sliding portion of the spacer section to the distal end of the spacer section is smaller than a length in the axial direction from the proximal end of the sliding portion of the spacer section to a boundary step of the cut face on the outer circumferential face of the plunger in a fully retracted position so that the position of the boundary step of the cut face on the outer circumferential face of the plunger in the fully retracted position is always located inside the cylinder section.

2. The plunger pump according to claim 1, wherein the length in the axial direction from the proximal end of the sliding portion of the spacer section to the distal end of the spacer section is larger than a length of the cylinder section in the axial direction.

3. The plunger pump according to claim 1, wherein the first hardness is 8 to 13 in Mohs hardness and the second hardness is 119 to 130 in Rockwell hardness in R scale.

4. The plunger pump according to claim 1, further comprising an axial seal provided at a proximal end side of the cylinder to seal between the cylinder and the plunger.

5. The plunger pump according to claim 1, wherein the spacer section is made of a water-repellant material.

6. The plunger pump according to claim 1, wherein a liquid reservoir is provided at least in one of an inner circumferential face of the spacer section, an inner circumferential face of the cylinder section, and an outer circumferential face of the plunger.

7. The plunger pump according to claim 1, wherein the plunger is made of a material having the first hardness.

8. The plunger pump according to claim 1, wherein the cylinder section is made of a silicon carbide or an alumina ceramic material, the plunger is made of any one of a silicon carbide, an alumina ceramic material, a zirconia ceramic material, and a stainless steel material, and the spacer section is made of a resin material having a compression strength of 89 MPa or above.

9. The plunger pump according to claim 8, wherein the resin material is any one of polyphenylene sulfide (PPS) resin, polyether ether ketone (PEEK) resin, polysulfone (PSU) resin, polyacetal (POM) resin, and polyamide 6 or Nylon 6 (PA6) resin.

* * * * *